US006923335B2

(12) United States Patent
Fujita et al.

(10) Patent No.: US 6,923,335 B2
(45) Date of Patent: Aug. 2, 2005

(54) CASE

(75) Inventors: Takahiro Fujita, Higashi-Osaka (JP); Michitoshi Takeda, Higashi-Osaka (JP)

(73) Assignee: M.F.V. Co., Ltd., Higashi-Osaka (JP)

( * ) Notice: Subject to any disclaimer, the term of this patent is extended or adjusted under 35 U.S.C. 154(b) by 0 days.

(21) Appl. No.: 10/397,193

(22) Filed: Mar. 27, 2003

(65) Prior Publication Data

US 2003/0192892 A1 Oct. 16, 2003

(30) Foreign Application Priority Data

Apr. 16, 2002 (JP) ..... 2002-113911

(51) Int. Cl.[7] ..... B65D 41/04

(52) U.S. Cl. ..... 220/291; 220/4.22; 220/375; 220/831; 220/DIG. 26; 215/306; 206/581; 206/823; 132/293

(58) Field of Search ..... 220/4.22, DIG. 26, 220/375, 291, 345.4, 831; 206/581, 823; 132/295, 293; 215/306

(56) References Cited

U.S. PATENT DOCUMENTS

| | | | | | |
|---|---|---|---|---|---|
| 322,370 | A | * | 7/1885 | Grosjean | 215/243 |
| 565,012 | A | * | 8/1896 | Moller, Jr. | 215/243 |
| 1,836,811 | A | * | 12/1931 | McNeal | 220/291 |
| 2,147,246 | A | * | 2/1939 | Martin | 220/291 |
| 2,192,361 | A | * | 3/1940 | Renest | 220/291 |
| 2,466,295 | A | * | 4/1949 | Algier | 220/291 |
| 2,588,275 | A | * | 3/1952 | Nadai | 215/306 |
| 2,937,781 | A | * | 5/1960 | Leach | 220/291 |
| 2,961,119 | A | * | 11/1960 | Leach | 220/291 |
| 2,965,260 | A | * | 12/1960 | Padykula | 220/291 |
| 3,950,055 | A | * | 4/1976 | Samuels et al. | 439/142 |
| 4,253,488 | A | * | 3/1981 | Leverberg | 137/382 |
| 4,526,289 | A | * | 7/1985 | Schiemann | 220/304 |
| 4,753,358 | A | * | 6/1988 | Virca et al. | 215/230 |
| 4,934,556 | A | * | 6/1990 | Kleissendorf | 220/269 |
| 5,215,204 | A | * | 6/1993 | Beck et al. | 215/252 |
| 5,246,125 | A | * | 9/1993 | Julian | 215/252 |
| 5,884,636 | A | * | 3/1999 | Sheffler et al. | 132/295 |
| 5,975,093 | A | * | 11/1999 | Joulia | 132/293 |
| 5,984,123 | A | * | 11/1999 | Mogami et al. | 215/235 |
| 6,129,088 | A | | 10/2000 | Favre | |
| 6,170,683 | B1 | * | 1/2001 | Montgomery | 215/235 |
| 6,336,460 | B2 | * | 1/2002 | Yuhara | 132/295 |
| 2002/0014493 | A1 | * | 2/2002 | Delmon | 220/836 |

FOREIGN PATENT DOCUMENTS

| | | |
|---|---|---|
| JP | 11-192123 | 7/1999 |

* cited by examiner

*Primary Examiner*—Lee Young
*Assistant Examiner*—James Smalley
(74) *Attorney, Agent, or Firm*—Oblon, Spivak, McClelland, Maier & Neustadt, P.C.

(57) ABSTRACT

A case capable of airtightly closing an opening of a mouth of a case body by screwing a lid on the case body; and rotating the lid smoothly in the circumferential direction when the lid is screwed on or unscrewed from the case body. The case including a case body having a mouth, and a lid detachably screwed on the mouth so as to close an opening of the mouth and connected to the case body via an opening and closing hinge so as to pivot in directions of opening and closing the mouth is provided with a rotary ring fitted and held around the mouth so as to rotate in a circumferential direction thereof and connected to the lid via the opening and closing hinge so that the lid rotates together with the rotary ring.

7 Claims, 14 Drawing Sheets

PRIOR ART

CASE

BACKGROUND OF THE INVENTION

1. Field of the Invention

This invention relates to a case suitably used to store cosmetics and perfume therein.

2. Description of the Related Art

Examples of cases suitably used to store cosmetics and perfume therein include a case disclosed in JP-A-11-192123.

As shown in FIG. 14, this case has a case body 61 having a first threaded portion 63 on a mouth 62 thereof, a lid 66 adapted to close an opening 65 of the case body 61 and having a second threaded portion 67 capable of being screwed on the case body 61, and a pin type opening and closing hinge 68 capable of forming a joint between the lid 66 and case body 61.

An upper end portion of this opening and closing hinge 68 and the lid 66 are connected together by a pin fastening structure having a connecting pin 70, in such a manner that the case can be opened by a pivotal movement of the lid 66 in the opening direction (direction of an arrow M in FIG. 14) about the pin-fastening structure as a fulcrum. The opening and closing hinge 68 is provided on a lower end portion thereof with a slidable flange 69 outwardly projecting from an outer circumference of the hinge 68. The slidable flange 69 fits in a housing 64 which is formed along the circumferential direction of the case body 61 and defines an upper opening having a substantially C-shaped cross section so that the flange 69 is guided by and moved slidingly with respect to the housing 64.

When the lid 66 is rotated in the direction in which the lid 66 is unscrewed from a closed state in which the lid 66 is screwed on the opening 65 of the case body 61, the opening and closing hinge 68 slides in the circumferential direction with the lid 66, and the lid 66 moves upward. The lid 66 can thereafter be opened by a pivotal movement in the opening direction about an upper end of the opening and closing hinge 68 as a fulcrum, and the content of the case can be taken out therefrom.

However, since the slidable flange 69 of the opening and closing hinge 68 is fitted in the interior of the housing 64 with clearances formed above and below the hinge 68 so as to allow the lid 66 to move upward when the case body 61 and the lid 66 are unscrewed, when the flange 69 slides in the interior of the housing 64, the flange rattles, hindering smooth rotation of the lid 66.

SUMMARY OF THE INVENTION

In view of above problem, the present invention provides a case adapted to be closed tightly at a mouth of a case body by screwing a lid on the case body, in which the lid can be rotated smoothly in the circumferential direction when the lid is screwed on or unscrewed from the case body.

A technical means according to the present invention for solving such a technical problem resides in a case including a case body 2 having a mouth 3, a lid 4 adapted to be detachably screwed on the mouth 3 so as to close an opening 7 of the mouth 3, the lid 4 being connected to the case body 2 via the opening and closing hinge 5 so as to pivot in directions in which the mouth 3 is opened and closed, and a rotary ring 6 being fitted and held around the mouth 3 so as to rotate in the circumferential direction thereof, the lid 4 being connected to the rotary ring 6 via the opening and closing hinge 5 so as to rotate together with the rotary ring 6.

Another technical means according to the present invention resides in that the mouth 3 is formed with a locking portion 9 along an outer circumference thereof, while the rotary ring 6 is formed with an engagement portion 10, the engagement portion 10 being engaged with the locking portion 9 for preventing the rotary ring 6 from coming off from the mouth 3.

Still another technical means according to the present invention resides in that a screw mechanism 11 is provided between the mouth 3 and the lid 4, the screw mechanism 11 being adapted to project the lid 4 outward with respect to the rotary ring 6 when the lid 4 is unscrewed from the mouth 3, and draw back the lid 4 into the interior of the rotary ring 6 when the lid 4 is screwed on the mouth 3.

A further technical means according to the present invention resides in that the opening and closing hinge 5 includes a connecting portion 13 provided on one of the lid 4 and the rotary ring 6, and a connecting pin 14 provided on the other thereof, the connecting portion 13 defining an engagement groove 15 to be engaged with the connecting pin 14, the engagement groove 15 having a vertically extended depth such that, when the groove 15 is relatively moved with respect to the connecting pin 14, the lid 4 can be moved toward and away from the rotary ring 6.

Another technical means according to the present invention resides in that the engagement groove 15 is provided in an inner side thereof with a plurality of positioning portions 17*a*, 17*b* for positioning the connecting pin 14 at a plurality of positions of movement thereof.

Still another technical means according to the present invention resides in that the diameter of the connecting pin 14 is set larger than the width of the engagement groove 15 so that a resistance against the movement of the lid 4 gradually increases during the pivotal movement of the lid 4 in the opening direction.

A further technical means according to the present invention resides in that the opening and closing hinge 5 includes a tongue 19 with a base end portion 26 secured to the lid 4 and with a tip end portion 27 secured to the rotary ring 6, the tongue 19 having a flexibility such as to allow the lid 4 to pivot in directions in which the lid 4 opens and closes the mouth 3.

DESCRIPTION OF THE PREFERRED EMBODIMENTS

The embodiments of the present invention will now be described with reference to the accompanying drawings.

Figure 1:
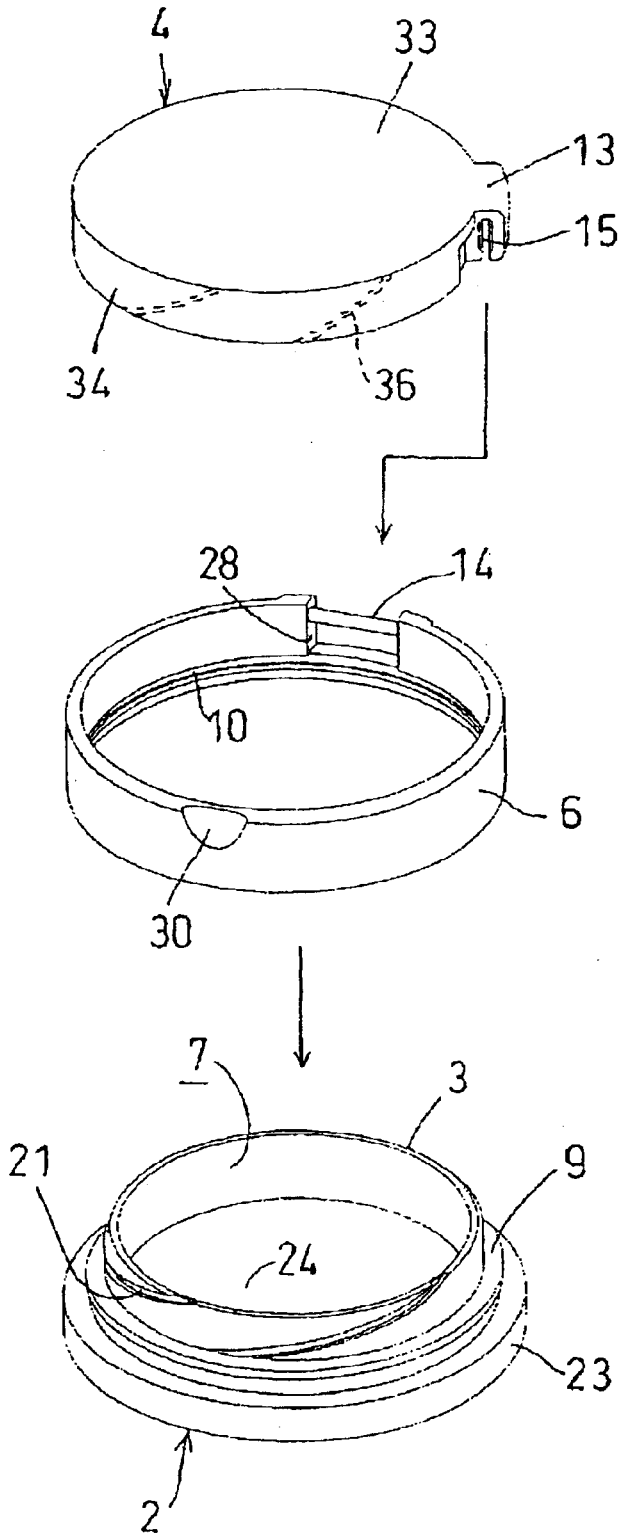
FIG. 1 is a perspective view showing a first embodiment of the present invention.
Figure 2:
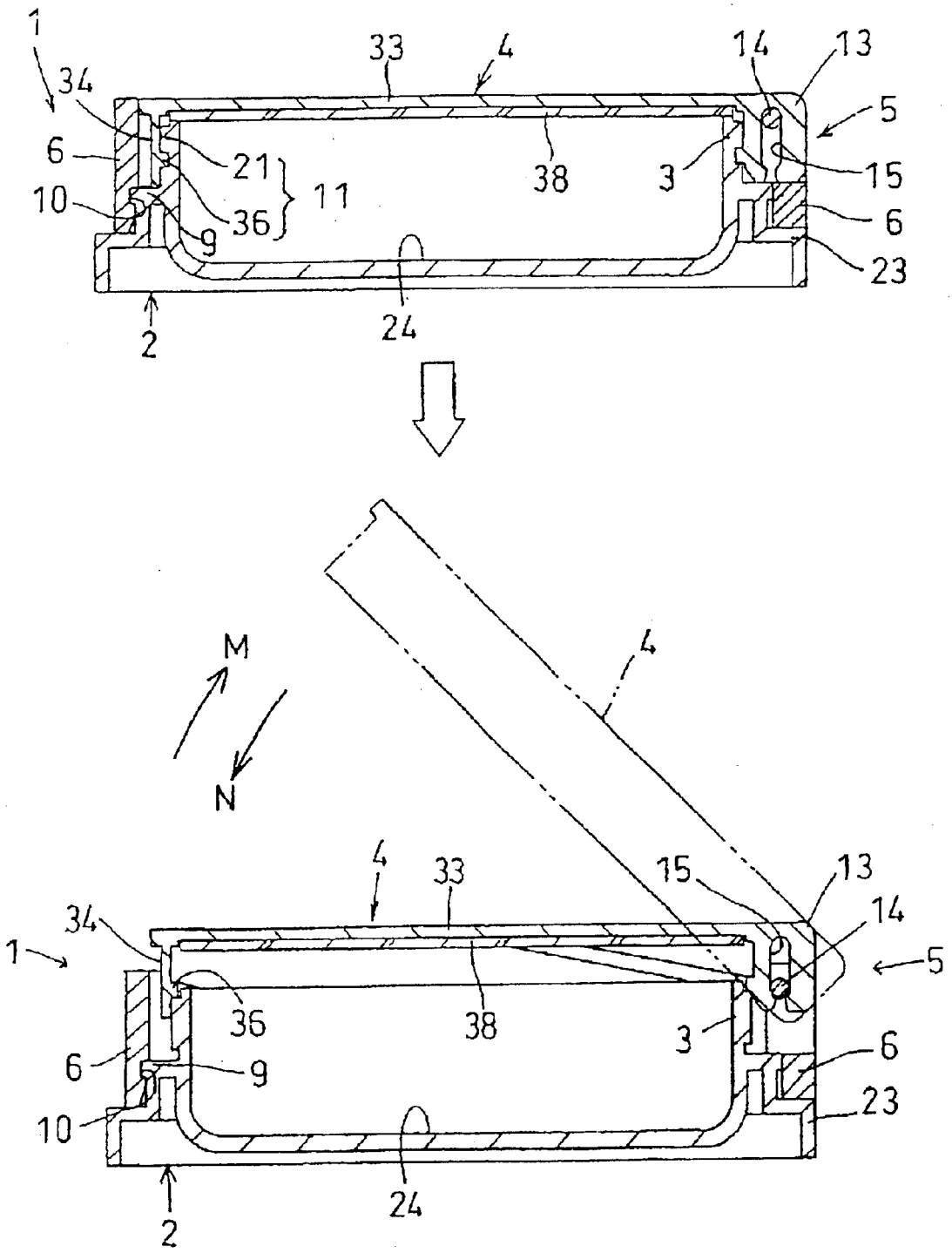
FIG. 2 is a side sectional view showing the first embodiment of the present invention.
Figure 3:
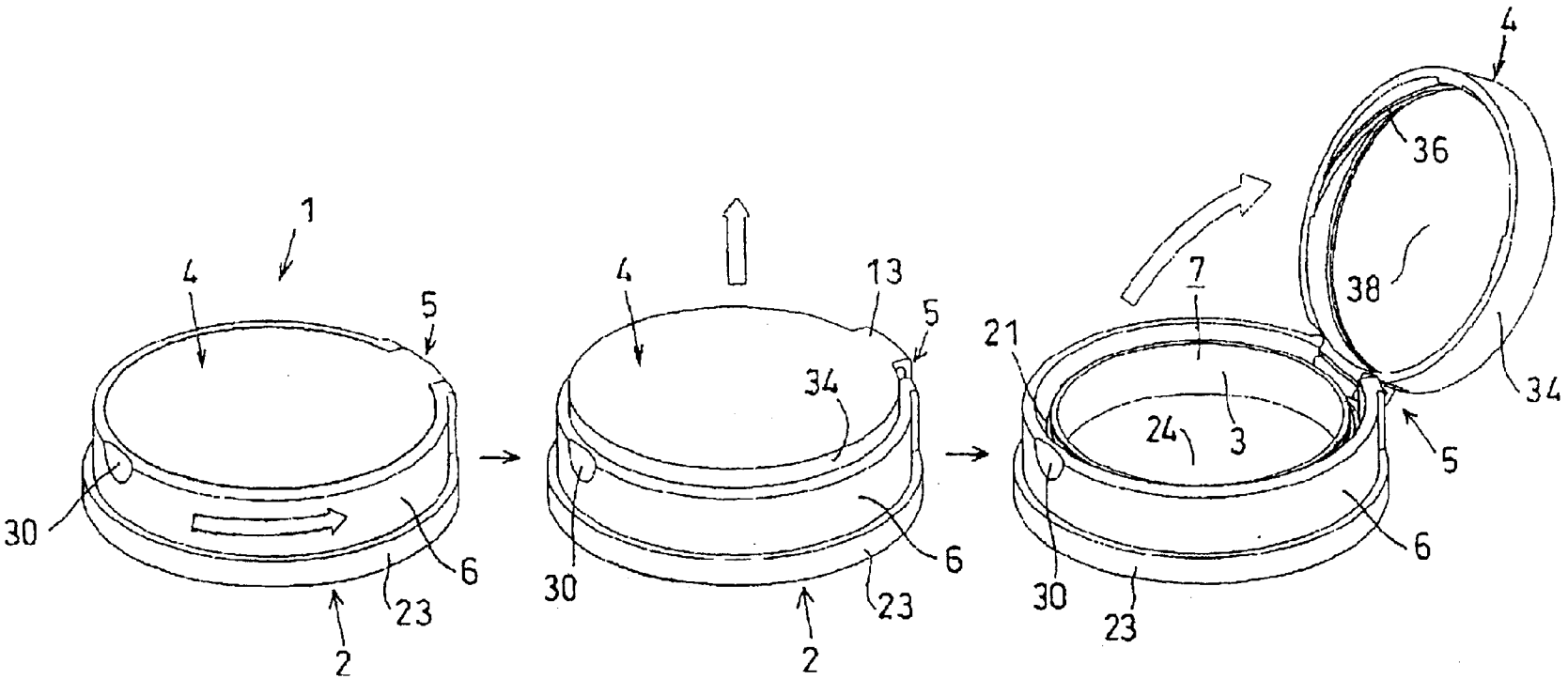
FIG. 3 is a perspective view showing a method of using the first embodiment.

FIGS. 1 to 3 show a first embodiment of a case 1 according to the present invention.

As shown in FIG. 1, the case 1 according to the present invention is provided with a case body 2 having a substantially cylindrical mouth 3, and a lid 4 adapted to be detachably screwed on the mouth 3 so as to close an opening 7 of the mouth 3. The lid 4 is pivotally connected to the mouth 3 in a manner like a hinged door via a rotary ring 6 fitted around the mouth 3 and an opening and closing hinge 5, so that the lid 4 pivots in the directions of opening and closing the mouth 3. On the inner side of this mouth 3, contents such as cosmetics including foundation, eyeshadow and rouge can be stored.

The case body 2 has a substantially circular shape in plan view as shown in FIGS. 1 and 2, and includes a storage hollow 24 for storing therein contents such as cosmetics, and a substantially cylindrical mouth 3 surrounding the storage hollow 24.

A first threaded portion 21 is formed on an outer circumferential surface of the mouth 3, and a projecting locking portion 9 is formed below the first threaded portion 21 (in the direction in which the lid 4 is fitted around the mouth 3) on the same outer circumferential surface so as to continuously extend therealong (form an annular locking portion). A radially outwardly projecting flange portion 23 is formed at the lowermost end of the outer circumferential surface of the mouth 3.

With the flange portion 23, a lower portion of the case body 2 is formed to have a large diameter, so that the case body 2 can be placed stably on a table or the like.

The rotary ring 6 is formed in a substantially cylindrical shape having a height substantially equal to that of the mouth 3, and fitted around the mouth 3. A recessed engagement portion 10 (annular engagement portion) is formed annularly in an inner circumferential surface of the rotary ring 6 so as to fit around the projecting locking portion 9.

The rotary ring 6 is further provided with a cutout portion 28 formed by cutting off in a downwardly recessed shape a part of an upper edge thereof. An elongated connecting pin 14 of a substantially circular cross section is provided so as to extend between upper (in the direction in which the lid 4 is removed from the mouth 3) sections of opposing inner surfaces of the cutout portion 28.

Since this connecting pin 14 is formed to extend between the upper end sections of the inner opposing surfaces of the cutout portion 28, the pin can be integrally molded with the rotary ring 6. However, a structure in which a connecting pin 14 is separately formed and fixed to the upper end portion of the cutout portion 28 may be employed without any problem.

The rotary ring 6 is formed with a chamfered portion 30 formed by a chamfering operation in the upper edge of the outer surface thereof on a position substantially opposing to the connecting pin 14.

The rotary ring 6 is fitted around the mouth 3 of the case body 2 so that the recessed engagement portion 10 is engaged with the projecting locking portion 9 of the mouth 3. With this structure, the rotary ring 6 can be rotated smoothly in the circumferential direction of the mouth 3, and fitted and held around the mouth 3. Since the recessed engagement portion 10 is engaged with the projecting locking portion 9, the rotary ring 6 neither moves out of place nor comes off from the mouth 3. Furthermore, the flange portion 23 formed below the mouth 3 also prevents the rotary ring 6 from coming off downward.

The lid 4 has a substantially circular lid portion 33 for closing the opening 7 of the mouth 3, and a circumferential wall 34 projecting downward from a circumferential edge of the lid portion 33. The circumferential wall 34 is provided in an inner circumferential surface thereof with a second threaded portion 36 which is engaged with the first threaded portion 21 to constitute a screw mechanism 11. The screw mechanism 11 enables the lid 4 to be screwed on the mouth 3 to tightly close the same.

The circumferential wall 34 is provided on a part thereof with an outwardly swollen connecting portion 13. This connecting portion 13 is provided with an engagement groove 15 extending therethrough in the circumferential direction and having a vertically extended depth. The connecting pin 14 provided in the rotary ring 6 is fitted in the engagement groove 15 to constitute an opening and closing hinge 5.

The lid 4 is connected to the rotary ring 6 in a manner like a hinged door via the opening and closing hinge 5. That is, the lid 4 is connected to the rotary ring 6 so as to pivot in the direction of opening the mouth 3 (arrow M in FIG. 2) and also in the direction of closing the same (arrow N in FIG. 2). Since the lid 4 is connected to the rotary ring 6 via the opening and closing hinge 5, the lid 4 can be rotated together with the rotary ring 6, and the lid 4 can also be rotated smoothly with respect to the mouth 3 in the circumferential direction thereof.

The lid portion 33 has on an inner surface thereof a seal member 38 adhered thereon. The seal member 38 is interposed between an upper edge of the mouth 3 and the inner surface of the lid portion 33 for improving airtightness of the case in a closed state in which the lid 4 is screwed on the mouth 3. In this embodiment, rubber or waterproofed paper is used as the seal member 38.

The state in which the lid 4 is screwed on the mouth 3 of the case body 2, i.e., the engagement of these parts in the closed state is shown in FIG. 2. Namely, the lid 4 is fitted around the mouth 3, and the rotary ring 6 is fitted around the lid 4. In this arrangement, at a lower portion of the rotary ring 6, the recessed engagement portion 10 is fitted around the projecting locking portion 9 as mentioned above, and thus the mouth 3 and rotary ring 6 are connected.

Therefore, the lid 4 is arranged to be fitted in an inner side of the rotary ring 6 when the lid 4 is closed, rotated together with the rotary ring 6 as mentioned above, and slidingly moved upward (in the direction in which the lid 4 projects outward) along an inner surface of the rotary ring 6 when the lid 4 and the rotary ring 6 are disengaged from each other (when the lid 4 is opened).

Though the case body 2, the rotary ring 6 and the lid 4 are formed of a material such as plastics by injection molding, the manufacturing method is not limited to this. When the case is required to have a high strength, the case may be formed by pressure molding a metal plate material, such as a steel plate without any problem. Further, the case may be formed by fitting a connecting pin 14 formed of a metal material in a rotary ring 6 formed of a plastic material without any problem.

A method of using the case 1 of this embodiment will now be described.

As shown in FIGS. 2 and 3, to open the case 1 in a closed state in which the lid 4 is closed by the engagement of the first and second threaded portions 21, 36 of the screw mechanism 11, the rotary ring 6 is rotated with respect to the mouth 3 in the direction in which the lid 4 is unscrewed from the mouth 3 (in counterclockwise direction). Since the lid 4 is counterclockwisely rotated together with the rotary ring 6, the engagement of the screw mechanism 11 is released, and the second threaded portion 36 constituting the screw mechanism 11 slidingly rises along the first threaded portion 21. Thus, the lid 4 moves upward (projects outward) gradually with respect to the mouth 3 to be opened. Since the engagement groove 15 has a depth extended in the vertical direction, the connecting pin 14 is moved downward with respect to the engagement groove 15, so that the lid 4 is moved upward smoothly with respect to the rotary ring 6 and projected outward.

When the lid is unscrewed, the lid 4 is caught at the chamfered portion 30 by a fingertip, and opened (pivotally moved in the opening direction) about the opening and closing hinge 5 as a fulcrum, allowing the contents of the case to be taken out easily.

In order to close the lid 4, the above-mentioned steps are carried out reversely. First, the lid 4 is closed (pivotally moved in the closing direction) about the opening and closing hinge 5 as a fulcrum. The rotary ring 6 is then rotated in the direction in which the rotary ring 6 is engaged with the lid 4 (in clockwise direction). As a result, the lid 4 is clockwisely rotated together with the rotary ring 6, so that the lid 4 is screwed on the mouth 3. During the screwing of the lid 4 on the mouth 3, the lid 4 moves downward with respect to the rotary ring 6 (retracts into the interior of the rotary ring 6) so that an upper surface of the lid 4 and an upper edge of the rotary ring 6 become flush with each other. Since the lid 4 is closed in a sealed state with respect to the mouth 3, inconveniences such as a leakage of content stored in the storage hollow 24 are prevented.

As described above, in the case 1 of this embodiment, the lid 4 is screwed on the mouth 3 via the screw mechanism 11 including the first and second threaded portions 21, 36, so that the storage hollow 24 can be closed with the lid 4 with the airtightness of the case 1 maintained.

The counterclockwise rotation of the lid to open the same can also be done smoothly by counterclockwisely rotating the rotary ring 6 to which the lid 4 is connected. Similarly, the clockwise rotation of the lid to close the same can also be done smoothly by clockwisely rotating the rotary ring 6 to which the lid 4 is connected.

When the rotary ring 6 is rotated, the lid 4 is moved vertically (in the projecting or retracting direction thereof) with respect to the rotary ring 6, i.e., the lid 4 projects from or retracts into the rotary ring 6. Therefore, since the lid 4 rises when it is opened, it can be visually confirmed that the lid is in an opened state. When the case 1 is in the closed state, since the upper surface of the lid 4 and the upper edge of the rotary ring 6 are flush with each other, the case 1 displays an effect of preventing a child or the like from opening the lid 4 inadvertently.

In short, the case 1 of this embodiment has both the convenience achieved by the pivotal movement of the lid 4 in opening and closing operations, and the airtightness of the case in a closed state which is achieved by the screwing engagement of the lid 4 and the mouth 3. Since the lid 4 pivots about the opening and closing hinge 5 as a fulcrum for opening and closing the case after the lid 4 rises with respect to the rotary ring 6, the case 1 can provide a user with an impression that the case is of a high grade.

A second embodiment of the present invention will now be described.

Figure 4:
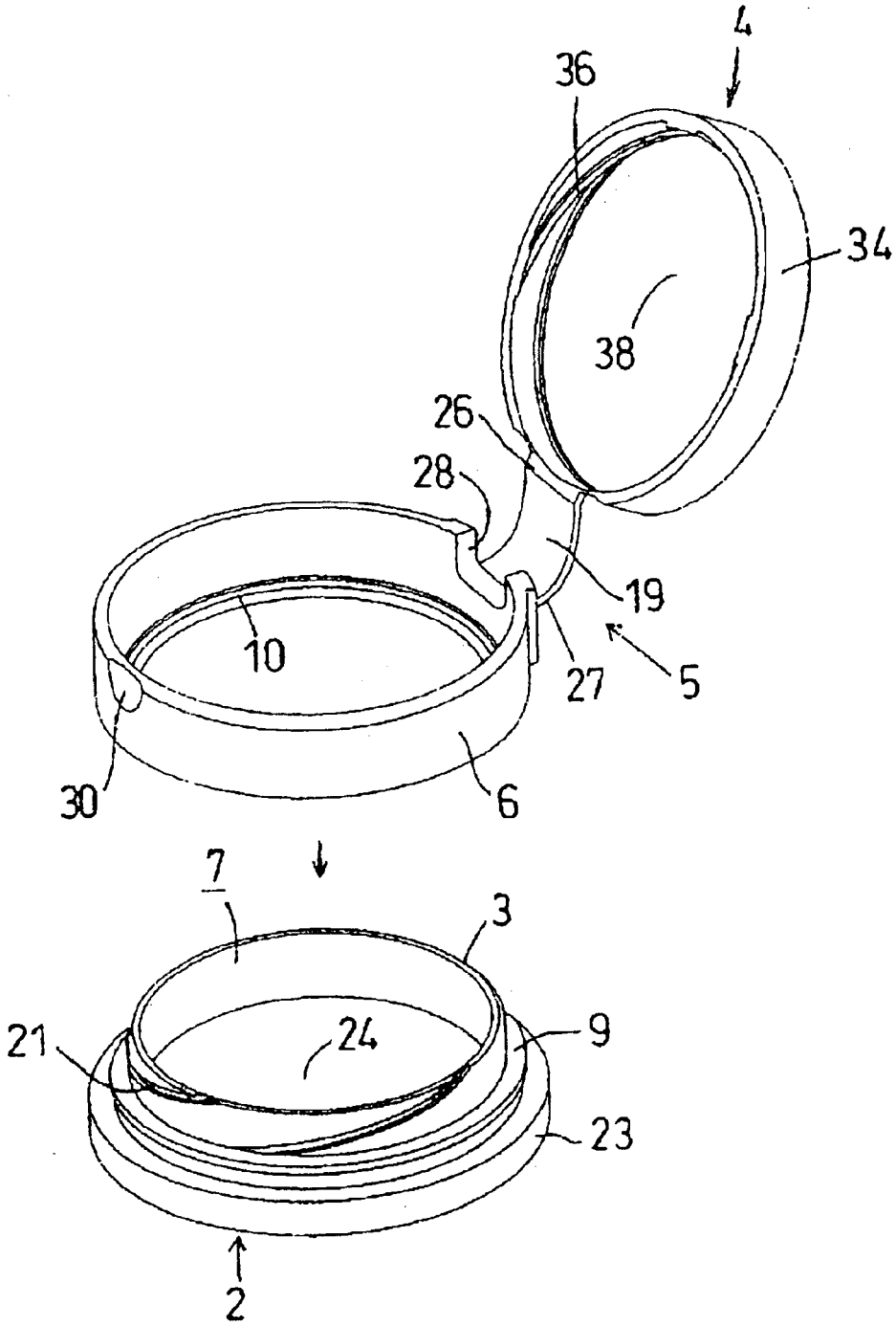
FIG. 4 is a perspective view showing a second embodiment of the present invention.
Figure 5:
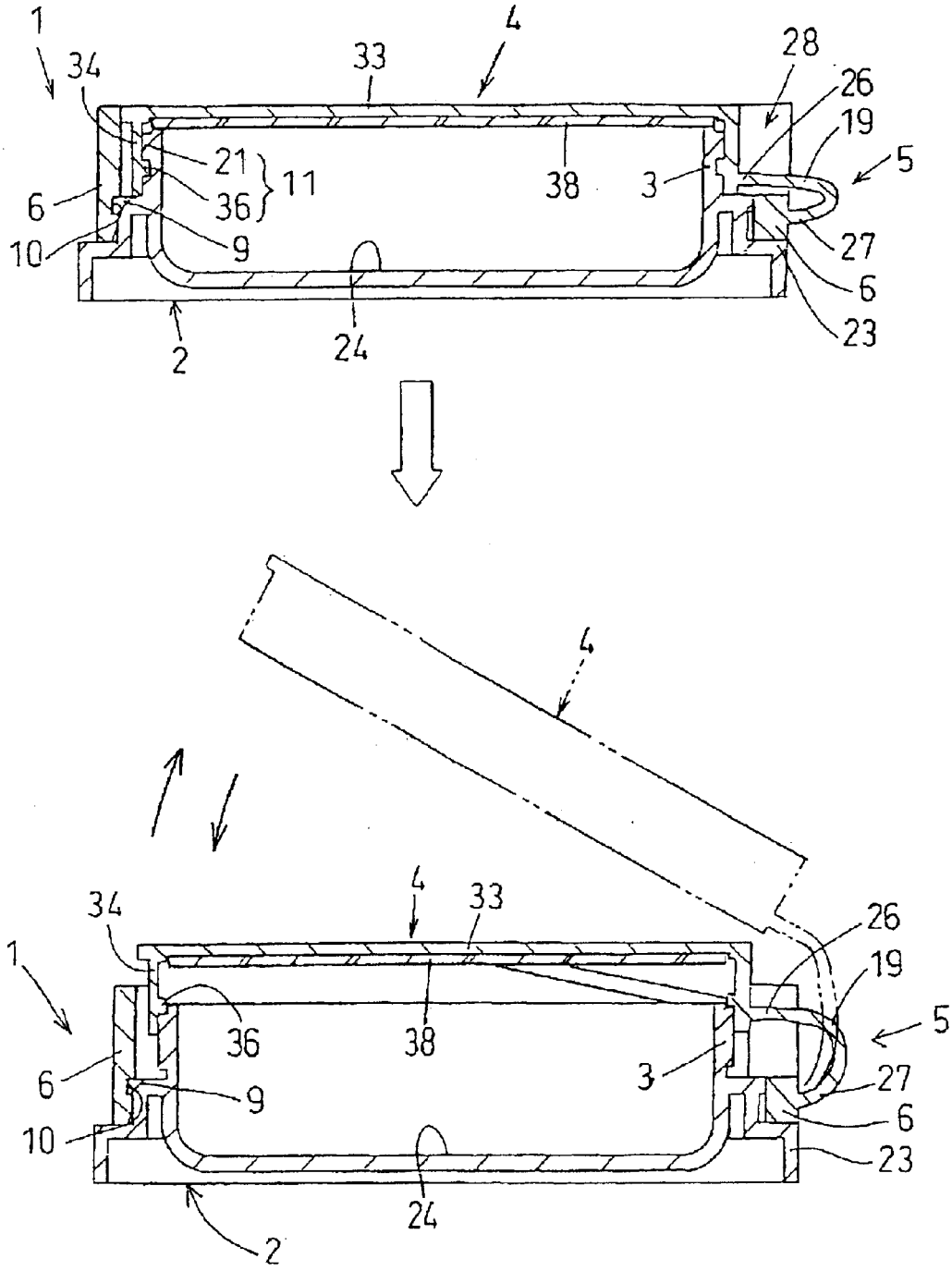
FIG. 5 is a side sectional view showing the second embodiment of the present invention.

As shown in FIG. 4, a case body 2, a rotary ring 6 and a lid 4 of the second embodiment of the present invention are identical with those of the first embodiment but an opening and closing hinge 5 connecting the lid 4 and the rotary ring 6 and enabling these parts to rotate simultaneously is different from that of the first embodiment.

Namely, the opening and closing hinge 5 in the second embodiment is formed as a tongue (tongue-like connecting member) 19 having a base end portion 26 secured to a lower end of an outer circumferential surface of a circumferential wall 34 of the lid 4, and a tip end portion 27 secured to an outer circumferential surface of the rotary ring 6. The tongue 19 has a flexibility such as to allow the lid 4 to pivot in the directions in which the lid 4 opens and closes a mouth 3.

Preferably, as in the first embodiment, a cutout portion 28 is formed by cutting off a part of an upper edge of the rotary ring 6 in a downwardly recessed shape, and the tip end portion 27 is secured to a position below the cutout portion 28. With this structure, the tongue 19 comes to fit in the cutout portion 28 when the lid is closed, so that the tongue 19 is prevented from being caught by the upper edge of the rotary ring 6, resulting in a reliable fitting of the lid 4 into the mouth 3.

The lid 4 connected to the rotary ring 6 via the opening and closing hinge 5 according to this embodiment is also rotated together with the rotary ring 6 and unscrewed to move upward with respect to the rotary ring 6 by a counterclockwise rotation of the rotary ring 6. A clockwise rotation of the rotary ring 6 causes the lid 4 to move downward, and the upper surface of the lid 4 and the upper edge of the rotary ring 6 to become flush with each other.

Thus, since the case has a structure in which the lid 4 and the rotary ring 6 are connected via the tongue 19, the lid 4, the rotary ring 6 and the tongue 19 connecting these members can be integrally molded of a plastic material and the like so as to simplify manufacturing steps and reduce manufacturing cost.

Modified examples of the embodiment of the case 1 according to the present invention will now be described.

Figure 6:
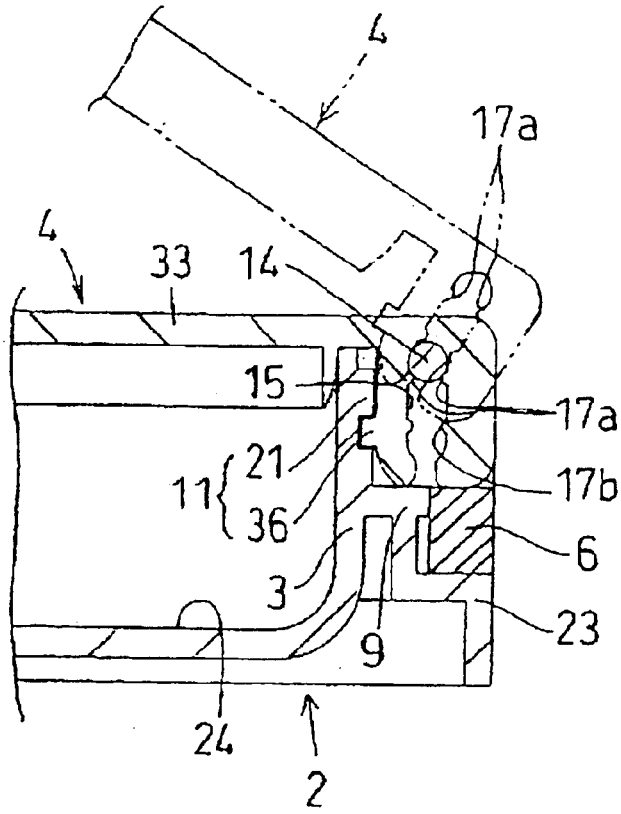
FIG. 6 is a sectional view showing a modified example of an opening and closing hinge in the first embodiment.
Figure 7:
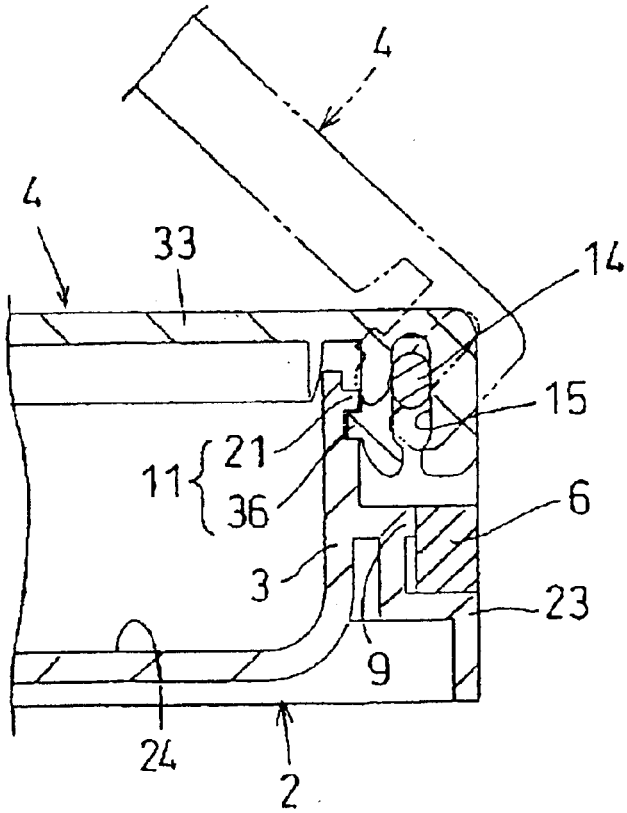
FIG. 7 is a sectional view showing another modified example of the opening and closing hinge in the first embodiment.

FIGS. 6 and 7 show modified examples of the opening and closing hinge 5 in the first embodiment.

Referring to FIG. 6, an engagement groove 15 is provided in an inner surface thereof with a plurality of positioning portions 17*a*, 17*b* formed as projections capable of setting a connecting pin 14 in an upper and a lower positions. Specifically, a pair of positioning portions 17*a* for setting the position of the connecting pin 14 when the lid 4 is closed are provided in an upper portion of the engagement groove 15, while a pair of positioning portions 17*b* for setting the position of the connecting pin 14 when the lid 4 is opened are provided in a lower portion of the engagement groove 15.

With this arrangement, a position of the connecting pin 14 in the engagement groove 15 when the lid 4 is in a projecting position with respect to the rotary ring 6, and a position of the connecting pin 14 in the engagement groove 15 when the lid 4 is in a retracting position with respect the rotary ring 6 are determined definitely.

When the lid in a closed state is shifted to an opened state or vice versa, since the connecting pin 14 passes through narrowed portions between the projecting positioning portions 17*a*, 17*b* in a space in the engagement groove 15, a user senses resistance (receives click noise) during the vertical movement of the lid 4 accompanying the rotation the rotary ring 6. This click noise provides the user with an impression that the case is of a high grade.

FIG. 7 shows another modified example in which a connecting pin 14 is formed to have a larger diameter than a width of an engagement groove 15 so that, when a lid 4 pivots in the opening direction, a resistance against the movement of the lid increases gradually. Specifically, a cross section of the connecting pin 14 is substantially elliptic, and a longer diameter thereof is larger than the width of the engagement groove 15 and extends in the vertical direction in the engagement groove 15. A shorter diameter of the connecting pin 14 is set smaller than the width of the engagement groove 15.

When the connecting pin 14 has such a shape, during a vertical movement of the lid 4, the connecting pin 14 moves smoothly in the vertical direction without being caught in the engagement groove 15. When the lid 4 pivots to open the same, as shown in two-dot line in FIG. 7, the end surfaces of the connecting pin 14 at positions having the longer diameter of its substantially elliptic cross section eat into an inner surface of the engagement groove 15, so that a user senses a resistance. The occurrence of such resistance can provide a user, when he uses the case, with an impression that the case has a high-grade design.

Modified examples of the rotary ring 6 in the first and second embodiments will now be described.

Figure 8:
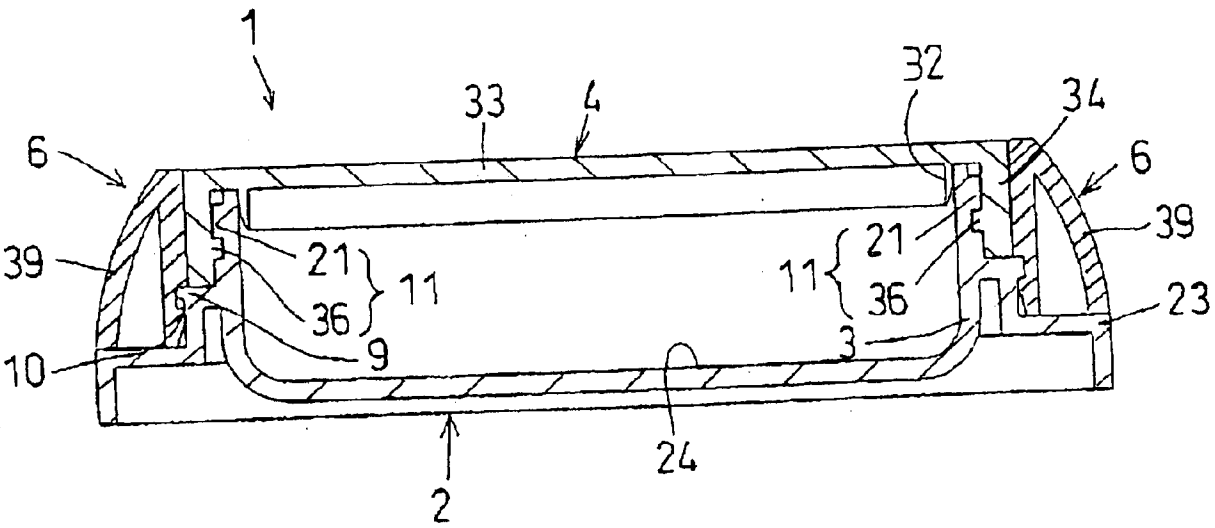
FIG. 8 is a sectional view showing a modified example of a rotary ring in the present invention.

FIG. 8 shows a rotary ring 6 having an outer circumferential surface formed in a shape of a substantially outwardly bulging arc. With this structure, since the rotary ring 6 has a bulging portion 39 on the outer circumference, a user can hold a case easily when he rotates the rotary ring 6, and is provided with an impression that the case has a high-grade design.

Figure 9:
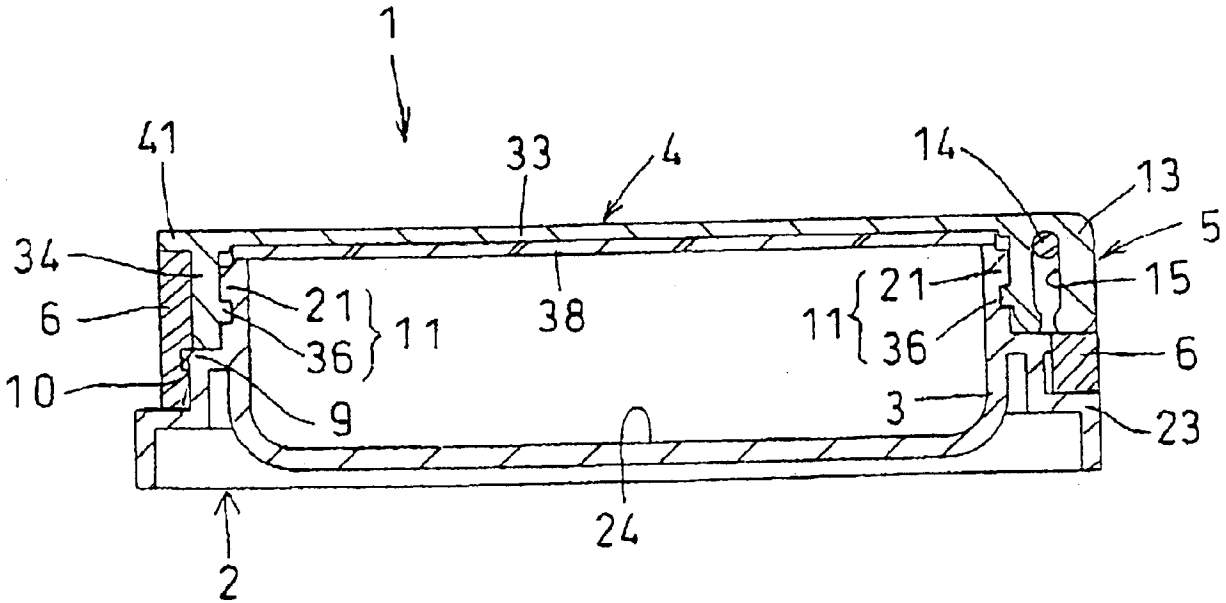
FIG. 9 is a sectional view showing another modified example of the rotary ring in the present invention.

FIG. 9 shows a rotary ring 6 and a lid 4 in which the lid 4 has a flange portion 41 radially outwardly projecting from a circumferential edge of a lid portion 33, so that the lid 4 fits in the rotary ring 6 with the flange portion 41 covering an upper portion of the rotary ring 6 when the lid 4 is closed. With this structure, since the flange portion 41 of the lid 4 is caught by a fingertip of a user when the lid 4 is opened, the use can cause the lid 4 to pivot to open the same very easily.

Figure 10:
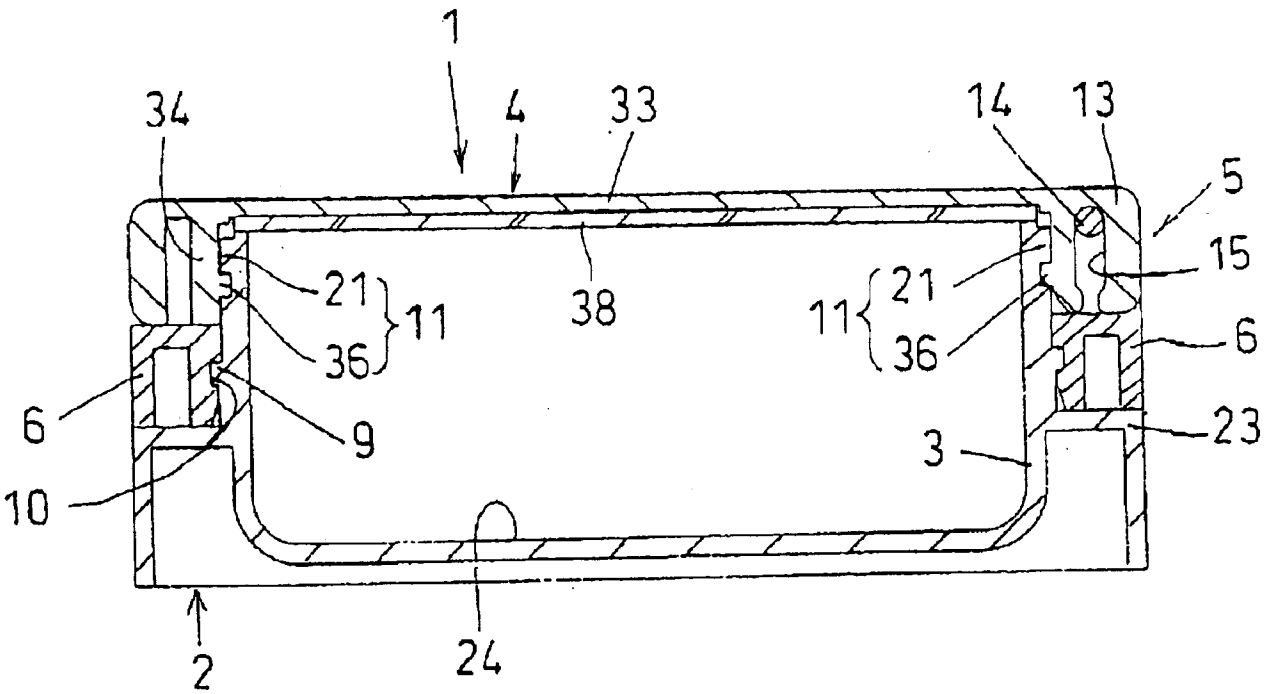
FIG. 10 is a sectional view showing still another modified example of the rotary ring in the present invention.

FIG. 10 shows a rotary ring 6 having a diameter substantially equal to that of the lid 4. In this example, a lid 4 is not fitted in an inner side of the rotary ring 6, but placed on the rotary ring 6.

In the respective modified examples described above, the functions of the rotary rings 6 are completely the same. However, since the case 1 according to the present invention is used as a case for storing cosmetics or the like, it is important to give a user an impression that the case is of a high grade. Therefore, modifying the design of the rotary ring 6 is very effective in achieving the above purpose.

Examples in which the storage hollows 24 in the first and second embodiments are modified will now be described.

Figure 11:
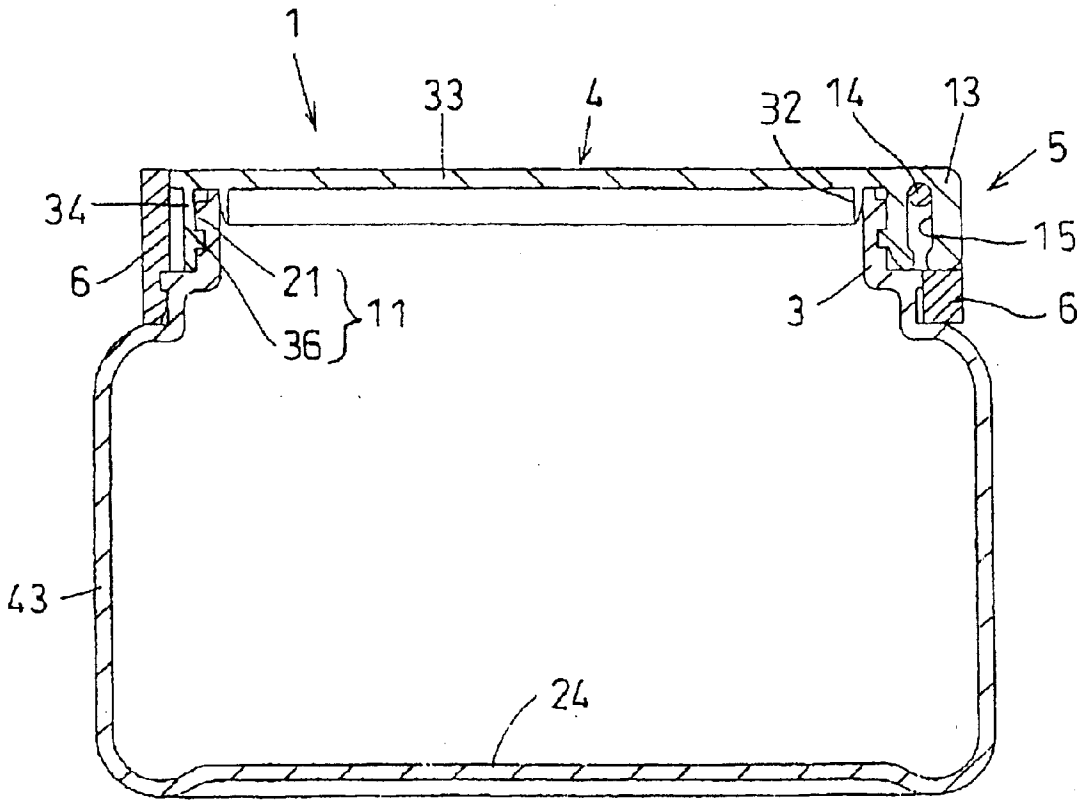
FIG. 11 is a sectional view showing a modified example of a storage hollow in the present invention.

FIG. 11 shows a storage hollow 24 expanded greatly in the downward direction so as to have a shape of a jar 43 in which cream or the like is stored.

The storage hollow 24 in the shape of the jar 43 can store therein contents such as moisture retaining cream, cleansing cream, hair wax or the like in large quantities. Since such cream contents generally have a fluidity, they need to be stored in a sealed state in a case 1. Therefore, it is very effective to use the case 1 according to the present invention for this purpose.

Figure 12:
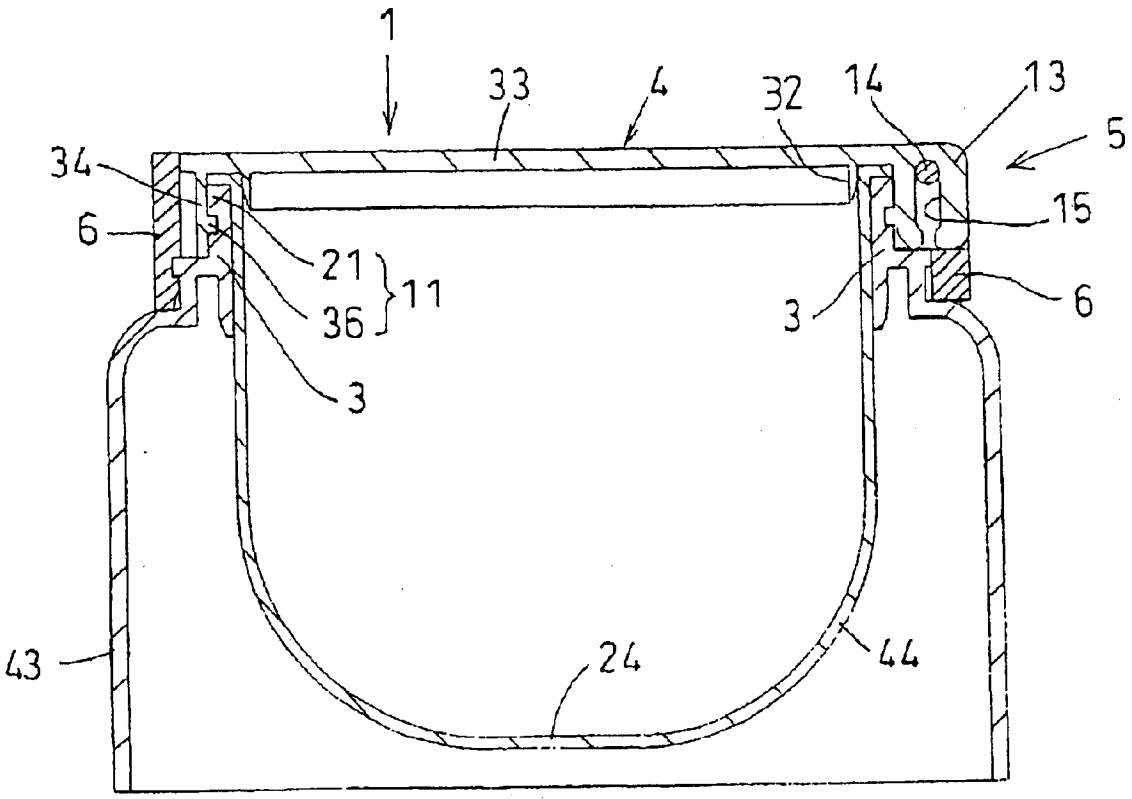
FIG. 12 is a sectional view showing another modified example of the storage hollow in the present invention.

FIG. 12 shows a case having a storage hollow 24 greatly expanded in the downward direction so as to have a shape of a jar 43 for storing cream or the like therein, in which a refill case 44 (refill) can be attached in the storage hollow on the inner side of a mouth 3.

It should be note that the present invention is not limited to these embodiments.

For example, the case 1 according to the present invention may be utilized as a cap 47 for a bottle 45 by opening a bottom of the storage hollow 24 of the case body 2 and mounting the case body 2 as an inner lid 48 to a mouth 46 of the bottle 45 (bottle body) without any problem.

Figure 13:
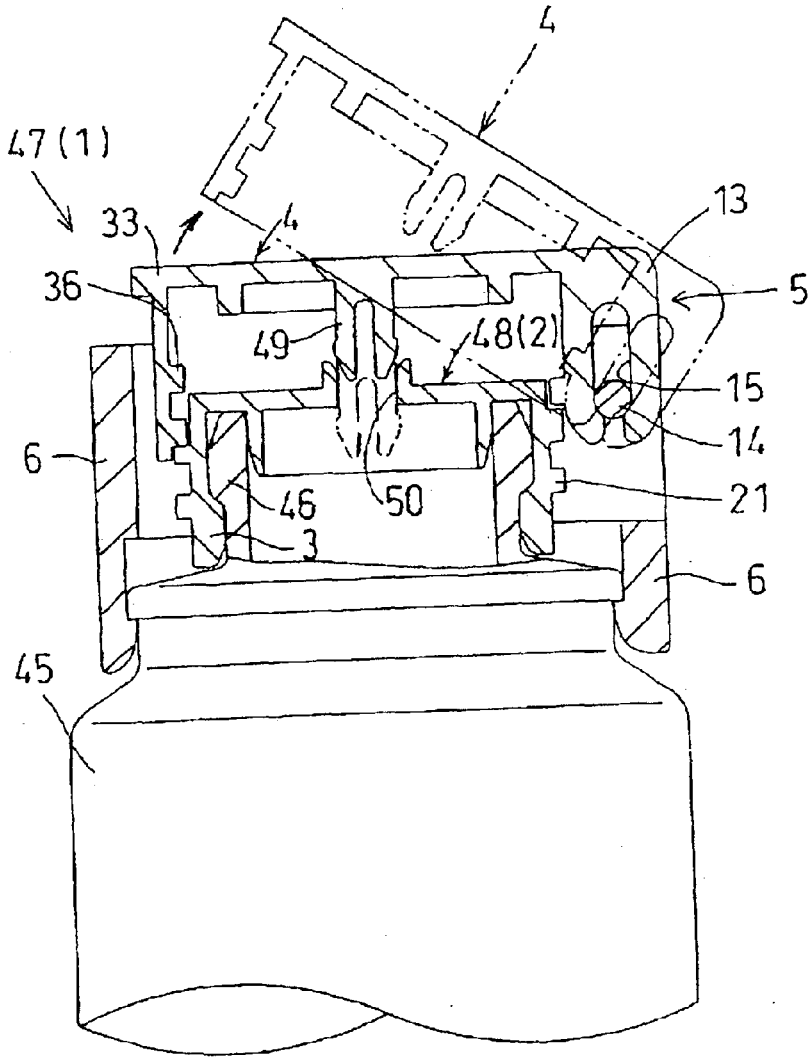
FIG. 13 is a sectional view showing a case according to the present invention used as a bottle cap.
Figure 14:
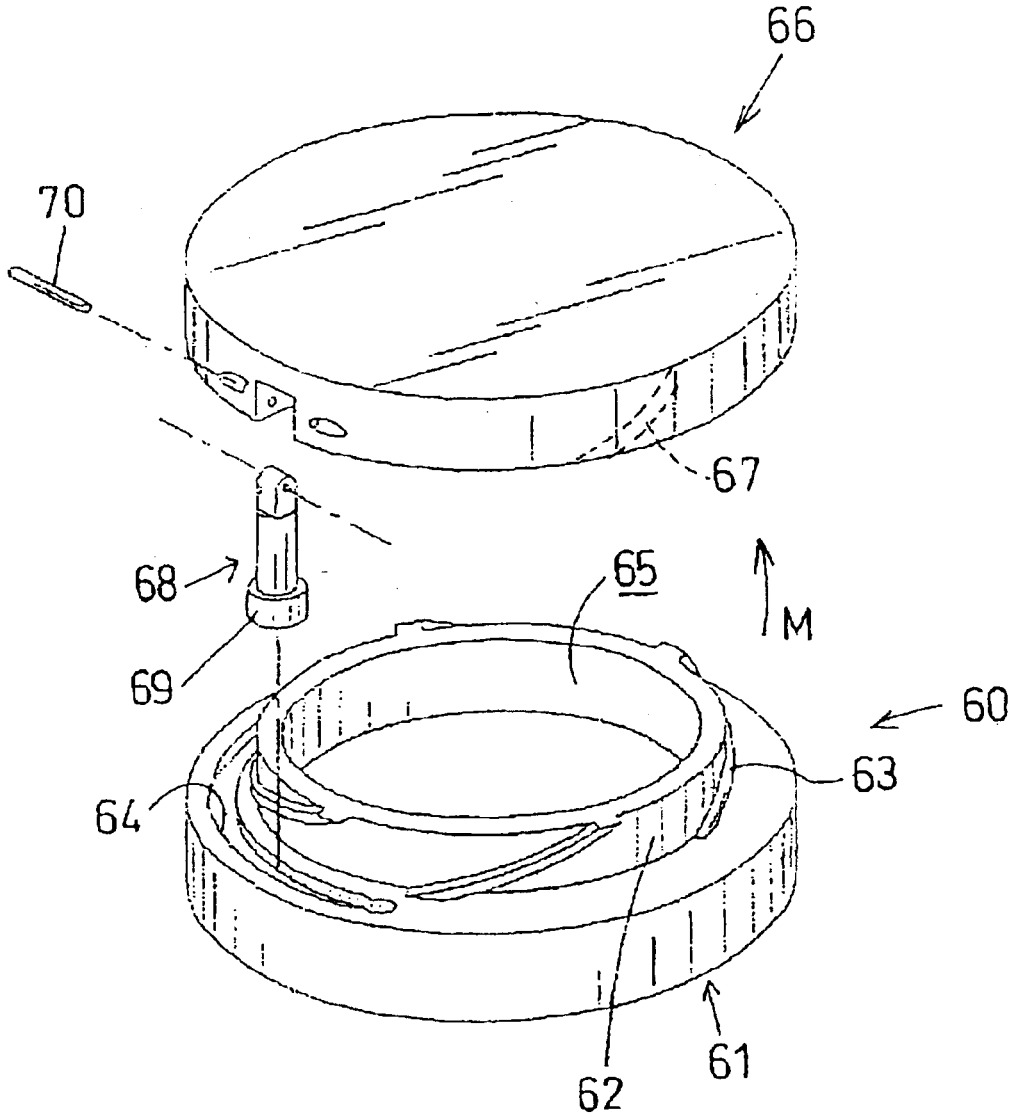
FIG. 14 is a perspective view showing a related art example of the case.

Specifically, as shown in FIG. 13, the inner lid 48 is fitted around the mouth 46 of the bottle, and a first threaded portion 21 is formed on an outer circumferential surface of the inner lid 48. The inner lid 48 is provided in a substantially central portion of an upper surface thereof with a hole 50 for discharging therefrom stored contents such as shampoo, rinse, lotion, a milky liquid, or the like. A lid body 33 is provided at a central portion of an inner surface thereof with a plug 49, which is adapted to be fitted into the hole 50 and thereby prevent the stored material from oozing out.

In order to pull out the plug 49 from the hole 50, also in this cap 47, the lid 4 is drawn out from the mouth 3 by rotating the rotary ring 6 counterclockwise, and then the lid 4 projecting above the rotary ring 6 is caused to pivot to open the same. The plug 49 is thus drawn out from the hole 50.

In addition, when these steps are carried out in reverse order, the plug 49 can be fitted into the hole 50.

Although the above embodiments of the case 1 are described to store cosmetics, for example, the contents are not limited thereto. Perfumes, medicines and paints, such as coloring materials may be stored in the case 1 without any problem.

In the embodiments, the projecting locking portion 9 is provided on the mouth 3 of the case body 2, while the recessed engagement portion 10 is provided in the inner circumferential surface of the rotary ring 6. Conversely, the projecting locking portion 9 and recessed engagement portion 10 may be provided on the inner circumferential surface of the rotary ring 6 and in the mouth 3 respectively without any problem.

Although the locking portion 9 in the embodiments is formed continuously on the outer circumferential surface of the mouth 3, the construction of the locking portion 9 is not limited to this. A locking portion 9 having a cutout section in a part thereof may also be provided. Alternately, a locking portion 9 extending along a part of the outer circumferential surface of the mouth 3 may also be provided. Similarly, the engagement portion 10 formed continuously in the inner circumferential surface of the rotary ring 6 is not limited to this construction. The engagement portion 10 may be provided discontinuously as long as the engagement portion 10 is fitted around the locking portion 9. Namely, the engagement portion 10 may be provided along a part of the inner circumferential surface of the rotary ring 6.

Further, in the foregoing embodiments, the opening and closing hinge 5 has a structure including the connecting pin

14 provided in the rotary ring 6, and the connecting portion 13 having the engagement groove 15 formed in the lid 4. Alternatively, a structure including the connecting pin 14 provided in the lid 4, and the connecting portion 13 having the engagement groove 15 formed in the rotary ring 6 may be employed without any problem.

In the first embodiment, a seal member 38 formed of rubber or the like is adhered on the inner surface of the lid body 33 so as to improve airtightnenss of the case when the lid 4 and the mouth 3 are engaged with each other (when the lid is closed). However, the material for improving the airtightness of the case in the closed state is not limited to this material. As shown in FIG. 8, the airtightness of the case in the closed state may also be improved by providing a ring-shaped rib 32 on the inner surface of the lid body 33 so that the rib 32 contacts the inner surface of the mouth 3.

In the case 1 according to the present invention, the opening 7 of the mouth 3 of the case body 2 can be sealed by screwing the lid 4 on the case body 2, and, when the lid 4 and case body 2 are engaged or disengaged from each other, the lid 4 can be rotated smoothly in the circumferential direction.

What is claimed is:

1. A case comprising:

a case body provided with a mouth;

a lid having a circumferential wall extending from a region substantially along a peripheral edge of the lid, the lid being configured to be detachably screwed on the mouth for closing an opening thereof;

a rotary ring fitted and held around the mouth so as to rotate in a circumferential direction thereof, wherein the lid is pivotally connected to the rotary ring via a hinge and is configured to rotate together with the rotary ring, and a portion of the lid is configured to fit substantially to the rotary ring when the mouth is closed with the lid; and a screw mechanism provided between the mouth and the lid, the screw mechanism being adapted to protect the lid outward with respect to the rotary ring when the lid is unscrewed from the mouth, and to draw back the circumferential wall into the interior of the rotary ring when the lid is screwed on the mouth.

2. A case as set forth in claim 1, further comprising a locking portion formed along an outer circumferential surface of the mouth, and an engagement portion formed in the rotary ring, the engagement portion being engaged with the locking portion so that the rotary ring is prevented from slipping off from the mouth.

3. A case as set forth in claim 1 or 2, wherein the opening and closing hinge has a connecting portion provided on the lid and a connecting pin provided on the rotary ring, or, alternatively, the opening and closing hinge has the connecting portion provided on the rotary ring and the connecting pin provided on the lid, the connecting portion being provided with an engagement groove to be fitted around the connecting pin, the engagement groove having a vertically extended depth such that relative movements of the engagement groove with respect to the connecting pin allow the lid to move in directions of outwardly projecting from and retracting into the rotary ring.

4. A case as set forth in claim 3, wherein the engagement groove is provided in an inner surface thereof with a plurality of positioning portions capable of setting the connecting pin at a plurality of positions of movement thereof.

5. A case as set forth in claim 3, wherein the connecting pin has a diameter larger than a width of the engagement groove so that a resistance against the movement of the lid changes when the lid pivots in the opening direction.

6. A case as set forth in claim 1 or 2, wherein the opening and closing hinge comprises a tongue having a base end portion secured to the lid, and a tip end portion secured to the rotary ring, the tongue having a flexibility such as to allow the lid to pivot in the directions of opening and closing the mouth.

7. The case according to claim 1, wherein the circumferential wall of the lid extends from the peripheral edge thereof.

* * * * *